US008471491B2

(12) United States Patent
Lu

(10) Patent No.: US 8,471,491 B2
(45) Date of Patent: Jun. 25, 2013

(54) METHOD FOR OPERATING AC LIGHT-EMITTING DIODE

(75) Inventor: Yu-Kang Lu, Taipei (TW)

(73) Assignees: Lite-On Electronics (Guangzhou) Limited, Guangzhou (CN); Lite-On Technology Corporation, Taipei (TW)

( * ) Notice: Subject to any disclaimer, the term of this patent is extended or adjusted under 35 U.S.C. 154(b) by 305 days.

(21) Appl. No.: 12/902,266

(22) Filed: Oct. 12, 2010

(65) Prior Publication Data

US 2011/0187281 A1 Aug. 4, 2011

(30) Foreign Application Priority Data

Jan. 29, 2010 (CN) ..... 2010 1 0106235

(51) Int. Cl.
*H05B 37/02* (2006.01)

(52) U.S. Cl.
USPC ..... 315/291; 315/246; 315/307

(58) Field of Classification Search
USPC ..... 315/185 R, 246, 291, 294, 297, 307, 315/311, 312, 325
See application file for complete search history.

(56) References Cited

U.S. PATENT DOCUMENTS

| | | | | |
|---|---|---|---|---|
| 7,319,298 | B2 * | 1/2008 | Jungwirth et al. | 315/307 |
| 7,679,292 | B2 * | 3/2010 | Allen et al. | 315/200 R |
| 2006/0082331 | A1 * | 4/2006 | Ashdown | 315/291 |
| 2009/0278476 | A1 * | 11/2009 | Baaijens | 315/297 |
| 2010/0013409 | A1 * | 1/2010 | Quek et al. | 315/294 |
| 2011/0018457 | A1 * | 1/2011 | Lan et al. | 315/250 |

* cited by examiner

*Primary Examiner* — Tung X Le
(74) *Attorney, Agent, or Firm* — Li&Cai Intellectual Property (USA) Office

(57) ABSTRACT

A method for operating an AC LED is disclosed. The method operates with an assumption that a linear relationship exists between the voltage and current of the AC LED operating at an active region. Hence, a first driving voltage and a second driving voltage are applied to the AC LED for respectively measuring a first driving current and a second driving current, and an interpolation is used for obtaining a third driving voltage. The third driving voltage is the predicted driving voltage for the AC LED. The method is capable of determining the actual driving voltage precisely and rapidly before the follow-up tests for other AC LEDs may proceed.

8 Claims, 2 Drawing Sheets

METHOD FOR OPERATING AC LIGHT-EMITTING DIODE

BACKGROUND OF THE INVENTION

1. Field of the Invention

The present invention relates to an operating method, and more particularly, to an operating method utilized on an alternating current (AC) light-emitting diode (LED).

2. Description of Related Art

LEDs have been widely applied in different fields with the continuous development of optoelectronic technology. The conventional LED chip is driven by a direct current (DC) power. A control circuit converting AC to DC and buck components are necessary for operating the conventional DC LED, since the AC power is widely utilized in our daily life. Thus, the conventional DC LED manufacturing cost would increase and the operational efficiency may be negatively affected. After year 2005, more and more AC LED chips have been released by the manufacturers.

Since the AC LED may operate with a starting voltage, the AC driving voltage has to surpass the starting voltage to turn on the AC LED. Meanwhile, also as the result of the starting voltage, a driving current waveform of the AC LED would change to a non-sinusoidal driving current signal waveform, increasing the difficulty for the measurement of the driving current of the AC LED. Furthermore, since the brightness of the AC LED may vary according to different driving current, the quality control for the AC LED may be more of a difficult task without the steady driving current.

Please refer to FIG. 1 where a circuit diagram of an AC LED is demonstrated.

The AC LED circuit 1 includes an AC power 10, an AC LED 11, and a resistor 12 connected in series. The AC power 10 could provide a driving voltage for triggering the AC LED 11 and adjust a driving current passing through the AC LED 11 by the resistor 12.

Please refer to FIG. 2 where an AC LED detecting circuit diagram is demonstrated.

The detecting circuit 2 comprises an AC power 21 and AC LED 22 connected in series. The AC power 21 provides an AC driving voltage and current. For the quality control purpose such as screening and grouping the AC LEDs, a consistent driving current as a threshold may be necessary.

The conventional detecting method for the AC LED 22 is an approach of trial and error, which applies a randomly selected AC testing voltage to the detecting circuit 2 for measuring a corresponding testing driving current. By repeatedly adjusting the value of the applied AC testing voltage, an AC testing voltage corresponding to a predetermined testing current could be obtained.

An improved testing method for the AC LED would select an AC LED (such as the AC LED 22) as a benchmark and determine a peak driving voltage Vp associated with a predetermined driving current Irms and a peak driving current Ip of the selected AC LED 22. The peak driving current Ip is thereafter applied to other AC LEDs for obtaining their corresponding peak driving voltages Vp. However, if the electrical characteristic of the selected AC LED 22 is not located at the middle of electrical characteristic distribution of all AC LEDs, the measurement for other AC LEDs on basis of the peak driving current Ip of the selected AC LED 22 may deviate.

SUMMARY OF THE INVENTION

The present invention provides an AC LED operation method which could predict a voltage of the AC LED operating with a predetermined driving current. According to the present invention, the operation method applies different driving voltages to the AC LED for obtaining different driving currents, and computes the predicted driving voltage with an interpolation as the AC LED is driven by the predetermined driving current. The operation method according to the present invention may obtain the current and voltage characteristic curve of the AC LED in accordance with the aforementioned driving voltages and driving current. Then, the predicted operation voltage could be obtained while the AC LED is driven by the predetermined driving current.

Consequently, with the operation method of the present invention, large amount of the AC LED testing would be rapidly finished and the testing results could be relatively accurate. According to the present invention, the constant driving current would be provided as a unified testing benchmark for promoting the product quality and the AC LED would be screened based on this unified testing benchmark.

In order to have further understanding regarding to the present invention, the following embodiments are provided along with illustrations to facilitate the disclosure of the present invention.

DETAILED DESCRIPTION OF THE PREFERRED EMBODIMENTS

Figure 3:
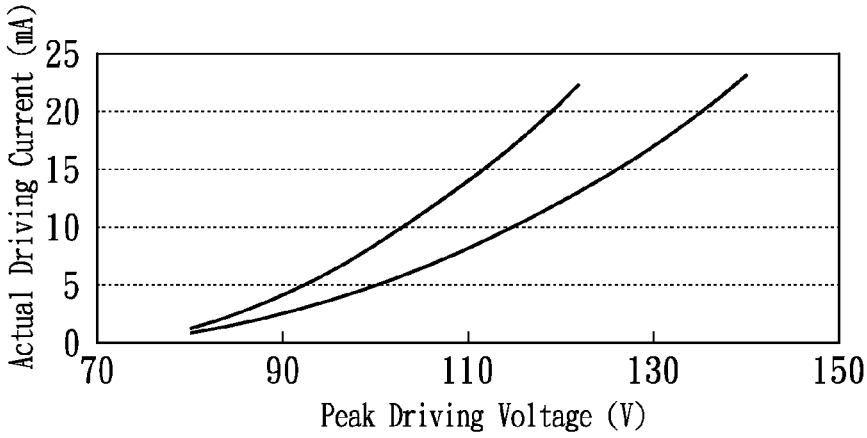
FIG. 3 (PRIOR ART)
FIG. 3 illustrates a AC LED voltage and current characteristic curves at an active region.

Please refer to FIG. 3 where an AC LED voltage and current characteristic curves at an active region is demonstrated.

Figure 4:
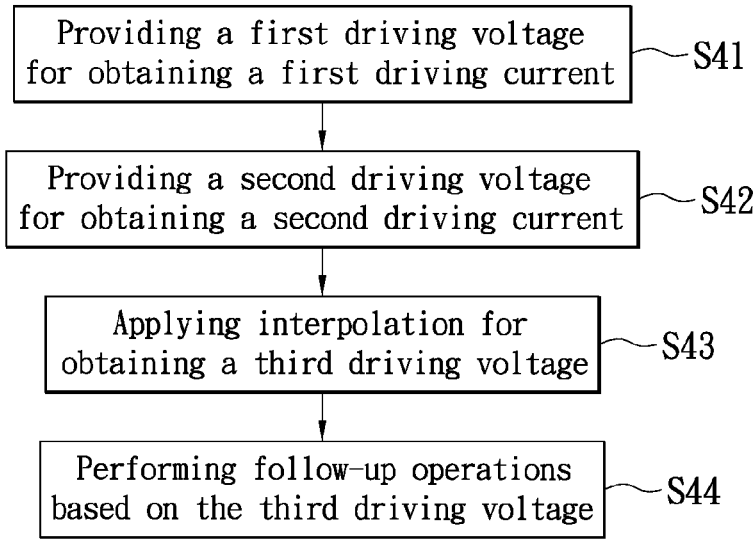
FIG. 4 illustrates a flowchart of a method of operating the AC LED according to one embodiment of the present invention.

Next, please refer to FIG. 4 where a flowchart of an operating method for the AC LED in accordance with one embodiment of the present invention is demonstrated.

As shown in FIG. 3, each of the two curves respectively corresponds to an AC LED with its own electrical characteristic of the driving voltage and the driving current. When the AC LED operates at the active region, an almost linear relationship may exist between the voltage and the current, i.e. the current-voltage curve is an almost linear curve. Thus, assume a linear relationship exists between the current and the voltage at the active region the driving voltage and the driving current for the AC LED may be approximated on basis of two referenced driving voltages and driving currents. Despite the approximated driving voltage and driving current may not be 100-percent accurate, they may still serve as the reference for the actual measurement.

Figure 1:
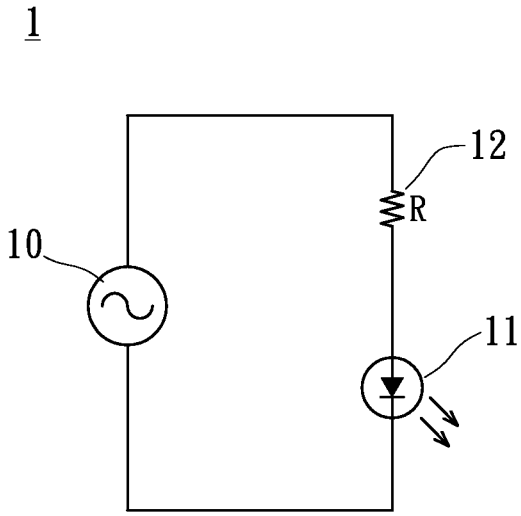
FIG. 1 (PRIOR ART)
FIG. 1 illustrates an AC LED circuit diagram.
Figure 2:
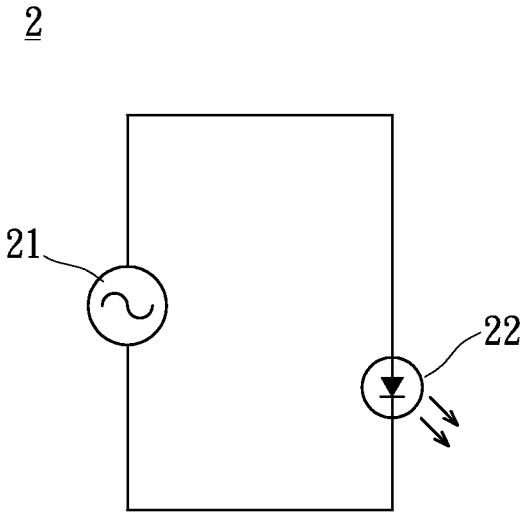
FIG. 2 (PRIOR ART)
FIG. 2 illustrates a AC LED detecting circuit diagram.

According to the method of the present invention, the AC power 21 shown in FIG. 2 would provide a first driving voltage (Vf1) with the detecting circuit 2 before a first driving current (If1) could be obtained, as shown in step S41. The first driving voltage (Vf1) is an AC voltage signal and the first driving current (If1) is an AC current signal. Then, a second driving current (If2) corresponding to the AC LED 22 could be obtained with an application of a second driving voltage (Vf2) by the AC power 21 to the detecting circuit 2, as shown in step S42. The second driving voltage (Vf2) is an AC voltage signal with a voltage value different to that of the first driving voltage (Vf1). The second driving current (If2) is an AC current signal also. In addition, according to the aforementioned assumption in which the linear relationship exists between the voltage and the current at the active region, a third driving voltage (Vrms) corresponding to the predetermined driving current (Irms) could be obtained by an interpolation, as shown in step S43. The third driving voltage is a predicted voltage as the AC LED 22 operates with the predetermined driving current (Irms). The third driving voltage (Vrms) is also an AC voltage signal.

Moreover, the third driving voltage (Vrms) may be further applied to other AC LEDs 22 having similar electrical characteristics for the follow-up operations such as measuring, testing, or verifying, as shown in step S44. A measured actual driving current (Irms') may be obtained with the application of the third driving voltage (Vrms) to the AC LED 22 before being compared with the predetermined driving current for verifying the accuracy of testing conditions. If the testing conditions are sufficiently accurate, the actual driving current (Irms') may be close to or even substantially the same as the predetermined driving current (Irms). It is worth noting that the first driving current (If1), the second driving current (If2), and the actual driving current (Irms') are currents which pass through the AC LED 22.

An example of the interpolation for the third driving voltage (Vrms) and the predetermined driving current (Irms) is as follows:

$$Vrms = Vf1 + \frac{(Vf2 - Vf1) \times (Irms - If1)}{If2 - If1}$$

The application of the first driving voltage (Vf1) and the second driving voltage (Vf2) to the AC LED 22 could lead to the first driving current (If1) and the second driving current (If2). The applications of the first driving voltage (Vf1), the second driving voltage (Vf2), the first driving current (If1), the second driving current (If2), and the predetermined driving current (Irms) to the aforementioned equation, a third driving voltage (Vrms) could be obtained. Thereafter, the third driving voltage (Vrms) may be applied to the detecting circuit 2 so as to have performed the follow-up characteristics testing on other AC LEDs 22 having same electrical characteristics.

The application of the third driving voltage (Vrms) to the detecting circuit 2 may verify the difference between the actual driving current (Irms') and the predetermined driving current (Irms) of the AC LED 22.

In other words, in view of the method for operating the AC LED according to the present invention, the current characteristic and the voltage characteristic of the AC LED operating at the active region may exist a linear relationship of the same slope. Since the first driving voltage (Vf1) and the second driving voltage (Vf2) may correspond to the first driving current (If1) and the second driving current (If2), respectively, after the applications of first driving voltage (Vf1) and the second driving voltage (Vf2) to the AC LED 22 the slope of the voltage/current characteristic curve would be (If2−If1)/(Vf2−Vf1). With the slope, the first driving voltage (Vf1), the first driving current (If1), and the predetermined driving current (Irms), the third driving voltage (Vrms) could be obtained on basis of the aforementioned equation.

It is worth noting that the setting of the first driving voltage (Vf1) and the second driving voltage (Vf2) may be determined according to an upper specification limit and a lower specification limit of the AC LED 22, and other experimental methods. For example, when the predetermined driving current (Irms) would be set at 20 mA and the driving voltage (Vrms) would be 90V. Therefore, the first driving voltage (Vf1) and the second driving voltage (Vf2) could be +2 or −2 Voltages off the driving voltage (Vrms). Furthermore, the setting values of the first driving voltage (Vf1) and the second driving voltage (Vf2) may be fixed or vary according to different AC LEDs. Moreover, the third driving voltage (Vrms) is between the first driving voltage (Vf1) and the second driving voltage (Vf2) in value. The first driving voltage (Vf1) and the second driving voltage (Vf2) may not be set too separated away from the third driving voltage (Vrms). Otherwise, unexpected errors may occur considering an approximately linear relationship (rather than an ideal linear relationship as assumed by the present invention) exists between the voltage and the current characteristics at the active region.

According to Table 1, which is the statistical result after the application of the approach according to the present invention to a number (e.g., 150) of AC LEDs, an averaged actual driving current (Irms') is 19.913 mA with the maximum actual driving current Irms' standing at 20.6 mA, the minimum actual driving current Irms' at 19.5 mA, and the standard variation thereof at 0.1378. It is worth noting that the predetermined driving current (Irms) is set to 20 mA. With an error percentage of −0.43%, the operating method according to the present invention is superior in locating the actual driving current within the neighborhood of the predetermined driving current, minimizing the likelihood of the deviation in the measurement of the actual characteristics of the AC LEDs.

TABLE 1

| Actual driving current (Irms') | Value (mA) | Error percentage |
|---|---|---|
| Average | 19.913 | −0.43% |
| Maximum | 20.6 | 3.00% |
| Minimum | 19.5 | −2.50% |
| Standard deviation | 0.1378 | 0.69% |

In the aspects of the aforementioned illustrations, the method for operating the AC LED according to the present invention may measure and test a large amount of AC LEDs. With regard to the method, a third driving voltage is capable of being applied to the plurality of different AC LEDs, so that an objective for providing a stable actual driving current Irms' may be achieved. Moreover, as the stable actual driving current Irms' is considered as a unified testing benchmark, the AC LEDs driven by the stable actual driving current Irms' may be screened and classified with superior accuracy, thereby achieving the ultimate objective of promoting final product quality.

The aforementioned descriptions represent merely the preferred embodiment of the present invention, without any intention to limit the scope of the present invention thereto. Various equivalent changes, alterations, or modifications based on the claims of present invention are all consequently viewed as being embraced by the scope of the present invention.

What is claimed is:

1. A method for operating an AC light-emitting diode (LED), adapted for predicting a driving voltage of the AC LED as the AC LED is driven by a predetermined driving current, comprising:

applying a first driving voltage to the AC LED for measuring a first driving current;

applying a second driving voltage to the AC LED for measuring a second driving current; and applying an interpolation in accordance with the first driving voltage, the first driving current, the second driving voltage, the second driving current, and the predetermined driving current so as to calculate a third driving voltage, wherein the third driving voltage is the predicted driving voltage of the AC LED when the AC LED is driven by the predetermined driving current, and the interpolation is performed according to an equation as follows:

$$V\text{rms} = Vf1 + \frac{(Vf2 - Vf1) \times (I\text{rms} - If1)}{If2 - If1},$$

in which Vrms is the third driving voltage, Vf1 is the first driving voltage, Vf2 is the second driving voltage, Irms is the predetermined driving current, If1 is the first driving current, and If2 is the second driving current.

2. The method for operating the AC LED according to claim 1, wherein the first driving voltage, the second driving voltage, and the third driving voltage are AC voltage signals and the first driving voltage and the second driving voltage are set to upper and lower specification limits of the AC LED.

3. The method for operating the AC LED according to claim 1, wherein the first driving current and the second driving current are AC current signals and the first driving current and the second driving current passing through the AC LED are of non-sinusoidal waveforms.

4. The method for operating the AC LED according to claim 1, further comprising applying the third driving voltage to the AC LED.

5. A method for operating an AC LED, adapted for predicting a driving voltage of the AC LED as the AC LED is driven by a predetermined driving current, comprising:

applying a first driving voltage to the AC LED for measuring a first driving current;

applying a second driving voltage to the AC LED for measuring a second driving current;

calculating a slope of voltage/current characteristic curve in accordance with the first driving voltage, the first driving current, the second driving voltage, and the second driving current; and calculating a third driving voltage in accordance with the slope, the first driving voltage, the first driving current, and the predetermined driving current, wherein the third driving voltage is the predicted driving voltage as the AC LED is driven by the predetermined driving current, and the third driving voltage is calculated according to an equation as follows:

$$Vrms = Vf1 + \frac{(Vf2 - Vf1) \times (Irms - If1)}{If2 - If1},$$

in which Vrms is the third driving voltage, Vf1 is the first driving voltage, Vf2 is the second driving voltage, and Irms is the predetermined driving current while If1 is the first driving current, If2 is the second driving current, and (If2-If1) /(Vf2-Vf1) is the slope.

6. The method for operating the AC LED according to claim 5, wherein the first driving voltage, the second driving voltage, and the third driving voltage are AC voltage signals and the first driving voltage and the second driving voltage are upper and lower specification limits of the AC LED.

7. The method for operating the AC LED according to claim 5, wherein the first driving current and the second driving current are AC current signals and the first driving current and the second driving current passing through the AC LED are of non-sinusoidal waveforms.

8. The method for operating the AC LED according to claim 5, further comprising applying the third driving voltage to the AC LED.

* * * * *